US005142830A

United States Patent [19]

Carpenter

[11] Patent Number: 5,142,830

[45] Date of Patent: Sep. 1, 1992

[54] ABRASIVE CLEANING MACHINE

[75] Inventor: James H. Carpenter, Hagerstown, Md.

[73] Assignee: Pangborn Corporation, Hagerstown, Md.

[21] Appl. No.: 512,178

[22] Filed: Apr. 20, 1990

[51] Int. Cl.[5] ..... B24C 3/18

[52] U.S. Cl. ..... 51/419; 51/215 AR; 51/215 CP; 51/215 UE; 51/417; 51/257 R; 51/423

[58] Field of Search ..... 51/215 R, 215 AR, 215 UE, 51/215 CP, 231, 232, 237 R, 410, 417, 418, 419, 420, 421, 422, 423, 426

[56] References Cited

U.S. PATENT DOCUMENTS

| | | | |
|---|---|---|---|
| 3,728,822 | 4/1973 | Noble | 51/419 |
| 3,748,787 | 7/1973 | Carpenter et al. | 51/420 |
| 3,813,817 | 6/1974 | Häberlin | 51/215 RX |
| 3,852,919 | 12/1974 | Baugman et al. | 51/419 |
| 4,018,006 | 4/1977 | Moelders | 51/423 X |
| 4,037,364 | 7/1977 | Freeman et al. | 51/420 X |
| 4,680,898 | 7/1987 | Carpenter, Jr. | 51/419 |
| 4,740,218 | 4/1988 | Hensley et al. | 51/215 ARX |
| 4,757,647 | 7/1988 | Hunziker | 51/417 |
| 4,844,232 | 7/1989 | Hunziker | 51/417 X |

*Primary Examiner*—Bruce M. Kisliuk
*Assistant Examiner*—John A. Marlott
*Attorney, Agent, or Firm*—Charles E. Brown

[57] ABSTRACT

This relates to an abrasive cleaning machine wherein there is mounted within a suitable frame or housing a work supporting conveyor which is mounted for both reciprocatory and rotational movement. When the conveyor is in the form of a rocker barrel, the rocker barrel is only oscillated. On the other hand, when the conveyor is in the form of a cage-like conveyor, the conveyor is continuously rotated. The principal feature is the mounting of the conveyor for such rotary and reciprocating movement. This includs a support structure in the form of a support sleeve mounted for rotation and a support shaft mounted within the support sleeve for relative reciprocatory movement. The support shaft carries a pair of longitudinal ribs which are engaged by rollers carried by the support sleeve to transmit rotational movement from the support sleeve to the support shaft. Thus the supporting of the conveyor is simplified. When the conveyor is of the cage-like type, it may be provided with a suitable gate and pusher arrangement for discharging workpieces at the terminal end thereof.

22 Claims, 6 Drawing Sheets

ABRASIVE CLEANING MACHINE

This invention relates in general to new and useful improvements in abrasive cleaning machines, and more particularly to an abrasive cleaning machine wherein there is provided a work supporting conveyor which may either be in the form of a rocker barrel or a cage type work support and wherein in the case of a rocker barrel, the rocker barrel is oscillated and at the same time axially reciprocated and in the case of the cage type work support, the cage type work support is continuously rotated and axially reciprocated.

It is known to mount work supporting conveyors for simultaneous rotational and axial movement. However, the supporting structures for such work supporting conveyors in the past has been relatively large and quite complicated. In accordance with this invention, there is provided a simplified support arrangement for a work supporting conveyor which includes a support shaft at each end of the conveyor with the support shaft being mounted for axial reciprocating movement within a support sleeve at each end of the machine. The support sleeve, in turn, is mounted in a bearing at the end of the machine for rotational or oscillating movement. The support shaft is mounted within the support sleeve for the reciprocating axial movement by way of a first set of bearings with the support shaft carrying axially extending ribs which are engaged by circumferentially arranged bearings or rollers for transferring and oscillating or rotational movement from the support sleeve to the support shaft.

In the case of a continuously rotating work supporting conveyor, the work supporting conveyor is simply rotated. On the other hand, when the work supporting conveyor is in the form of a rocker barrel, the support sleeve at one end only of the machine may be provided with a large diameter wheel-like member which has fixedly secured thereto a segment of a chain and this chain segment is engaged by an oscillating sprocket to effect the oscillation of the rocker barrel.

Suitable eccentric crank means are connected to the work supporting conveyor for effecting the reciprocation movement thereof.

In the case of a continuously rotated cage type work supporting conveyor, at the discharge end of the cage, the cage may include a hinged section which, when the workpiece reaches the end of its travel, is pivoted to a discharging position, after which the workpiece may be engaged by a suitable pusher to discharge the same.

With the above and other objects in view that will hereinafter appear, the nature of the invention will be more clearly understood by reference to the following detailed description, the appended claims, and the several views illustrated in the accompanying drawings.

Figure 1:
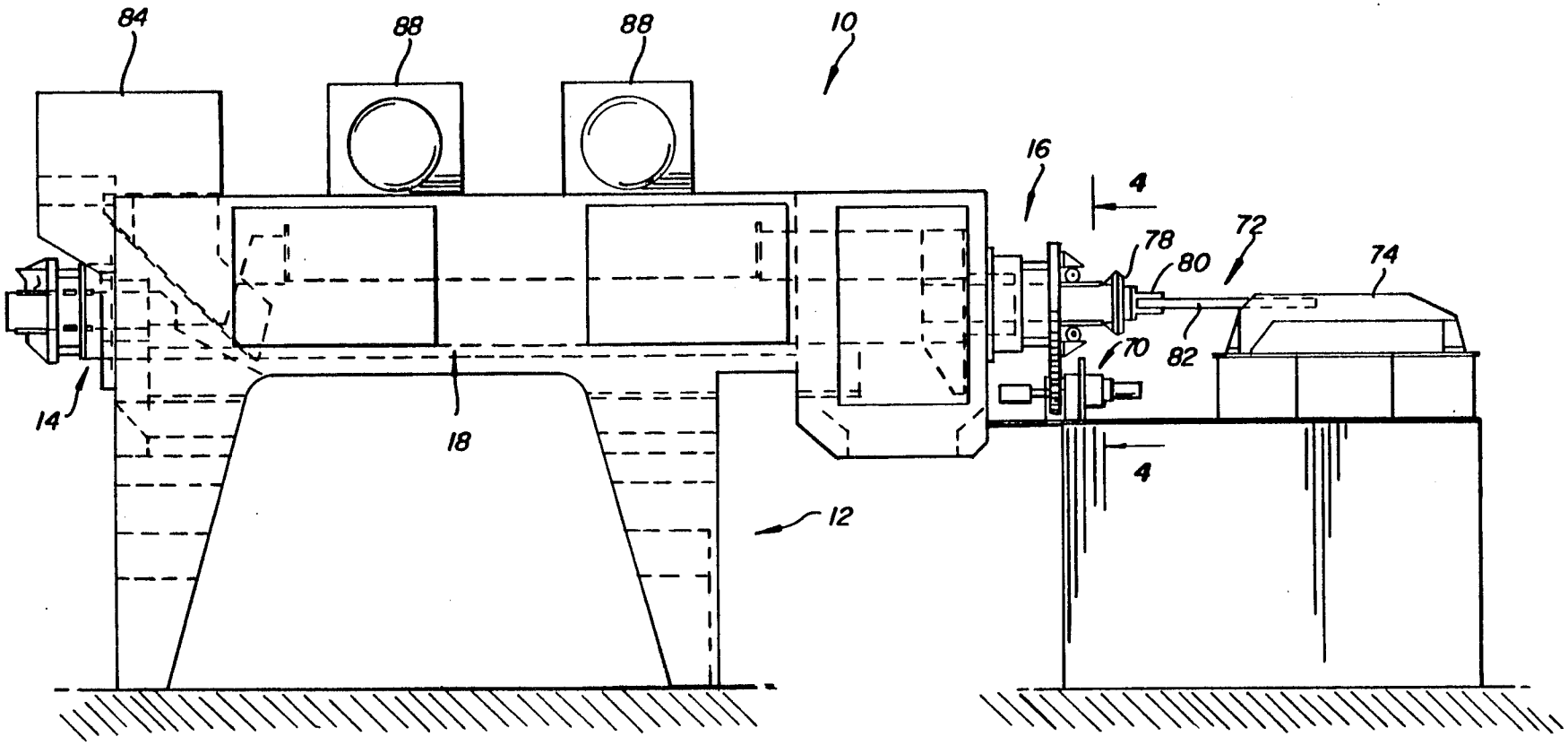
FIG. 1 is a side elevational view of that form of the invention incorporating a rocker barrel and shows an oscillating type drive connection therewith.

Referring now to the drawings in detail, reference is made first to FIGS. 1 through 6 wherein there are illustrated the details of an abrasive cleaning machine formed in accordance with this invention wherein the work supporting conveyor is in the form of a rocker barrel. The abrasive cleaning machine of FIGS. 1 through 6 is generally identified by the numeral 10 and includes a supporting frame generally identified by the numeral 12. The frame 12 is provided at opposite ends thereof with support means 14 and 16 for a rocker barrel 18 which is mounted within the support frame 12. At this time it is to be understood that the rocker barrel 18 is mounted and driven for both reciprocatory axial movement and oscillatory movement. It is also to be understood that the support means 14 and 16 may be identical except that the support means 16 includes suitable drive means. Accordingly, only the specific details of the support means 16 will be set forth hereinafter.

Figure 5:
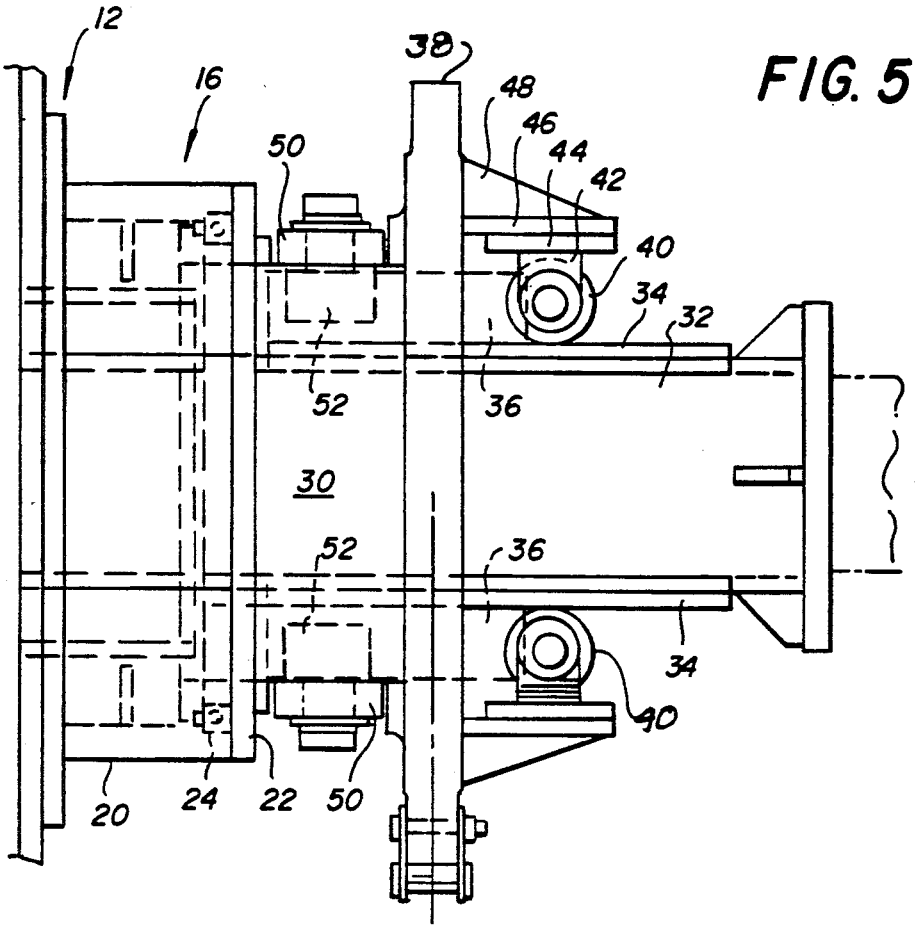
FIG. 5 is an enlarged fragmentary elevational view showing the specific mounting of the support shaft for the rocker barrel at the drive end of the machine.
Figure 6:
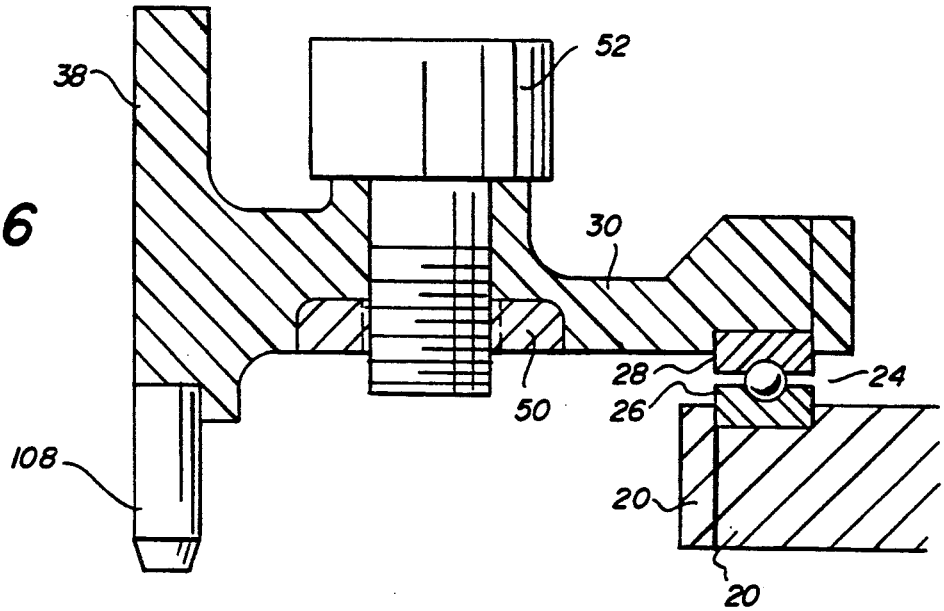
FIG. 6 is a fragmentary sectional view taken through the support sleeve and shows generally the mounting thereof, the support sleeve carrying a sprocket for the continuous rotation of the associated work supporting conveyor.

Referring now to FIG. 5, it will be seen that the support means 16 includes a tubular extension 20 of the support frame 12. The tubular extension 20 is closed by an end ring 22 which mounts within the tubular extension 20 a large diameter bearing 24 as is generally illustrated in FIG. 6. The bearing 24 includes an outer race 26 which is suitably seated within the tubular extension 20 and an inner race 28 which carries a support sleeve 30. The support sleeve 30, in turn, supports for axial reciprocatory movement a support shaft 32.

Figure 4:
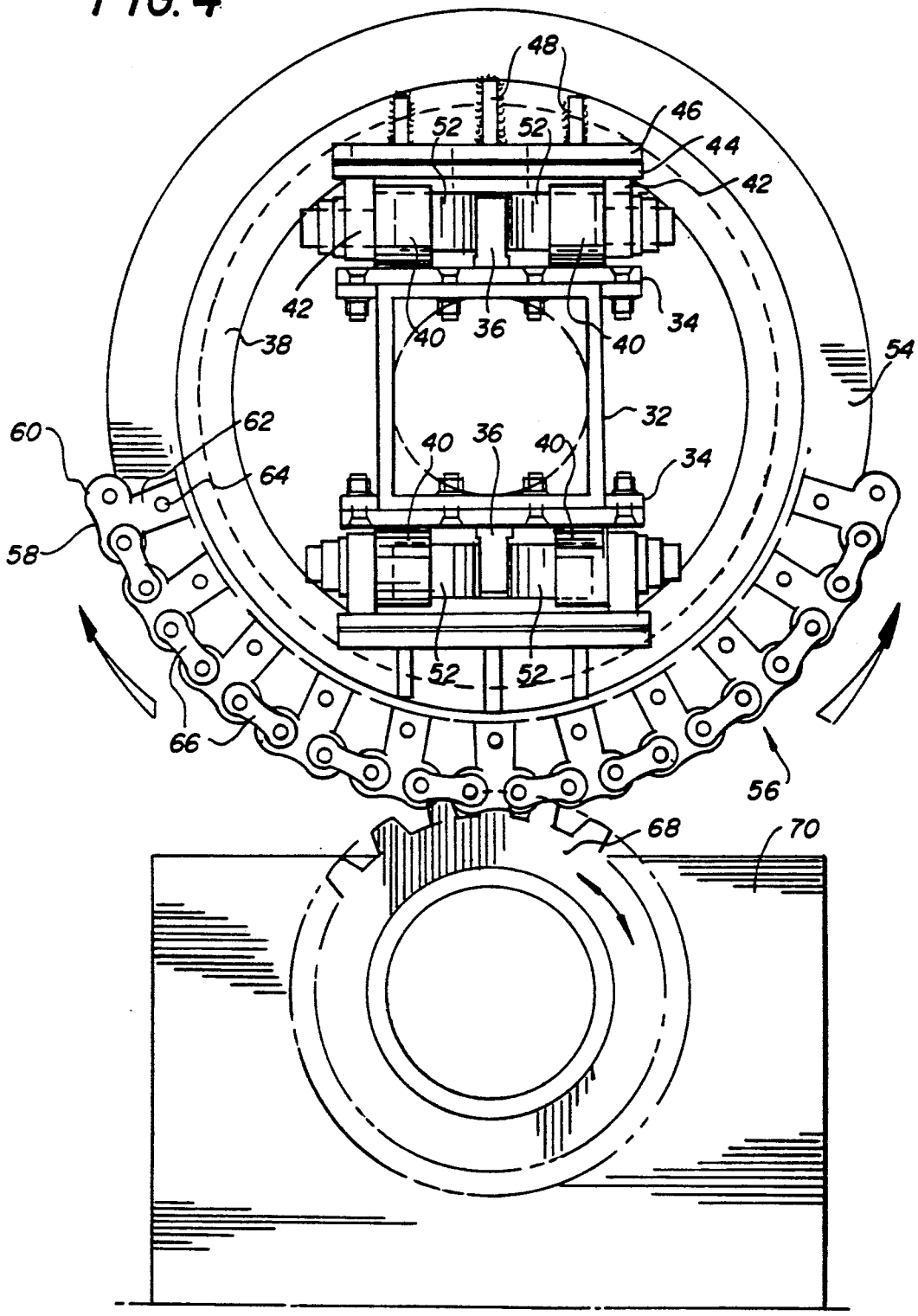
FIG. 4 is a fragmentary vertical sectional view taken generally along the line 4—4 of FIG. 1 and shows both the specific support structure for the rocker barrel at one end thereof and the means for effecting oscillation of the rocker barrel.

Referring now to FIG. 4, it will be seen that the support shaft 32 is in the form of a tubular beam which has fixedly secured to two opposite faces thereof support plates 34. The support plates 34, in turn, carry a centrally located, axially extending rib 36 for a purpose to be described in detail hereinafter.

As is shown in FIG. 6, the support sleeve 30 is provided at the free end thereof with a ring portion 38. The ring portion 38 supports two sets of support rollers 40. The support rollers 40, in the central position of the rocker barrel 18, engages the top and bottom of the support shaft 32 and more specifically bear against the surfaces of the plates 34. Each support roller 40 is supported by a bracket 42 which is secured to a transverse plate 44 which, in turn, is carried by a plate 46 that is welded to the ring 38. Each plate 46 is reinforced by gussets 48.

In the foregoing manner, the support shaft 32 is mounted for axial reciprocating movement.

It will be seen that the support sleeve 30 carries in diametrically opposite relation a transversely extending support bar 50, which in turn, carries a pair of rollers 52 which form suitable bearing means that bear against the opposite faces of the ribs 36 as is generally shown in FIG. 4. In this manner rotational movement of the support sleeve 30 is transferred to the support shaft 32.

Referring once again to FIG. 4, it will be seen that the support sleeve 30 carries a ring member 54 which has fixedly secured thereto a chain segment generally identified by the numeral 56. The chain segment includes roller units 58 which have side plates 60 provided with extensions 62 which are suitably secured in fixed relation to the ring member 54 by fasteners 64 which may be in the form of rivets. The chain segment 56 is completed by way of conventional side plates 66 joining together the roller plates 58.

The chain segment 56 is engaged by a sprocket 68 which is driven by a drive unit 70 for oscillatory movement. The drive unit 70 is only generally illustrated in FIGS. 1 and 4 and it is of a conventional construction.

Figure 2:
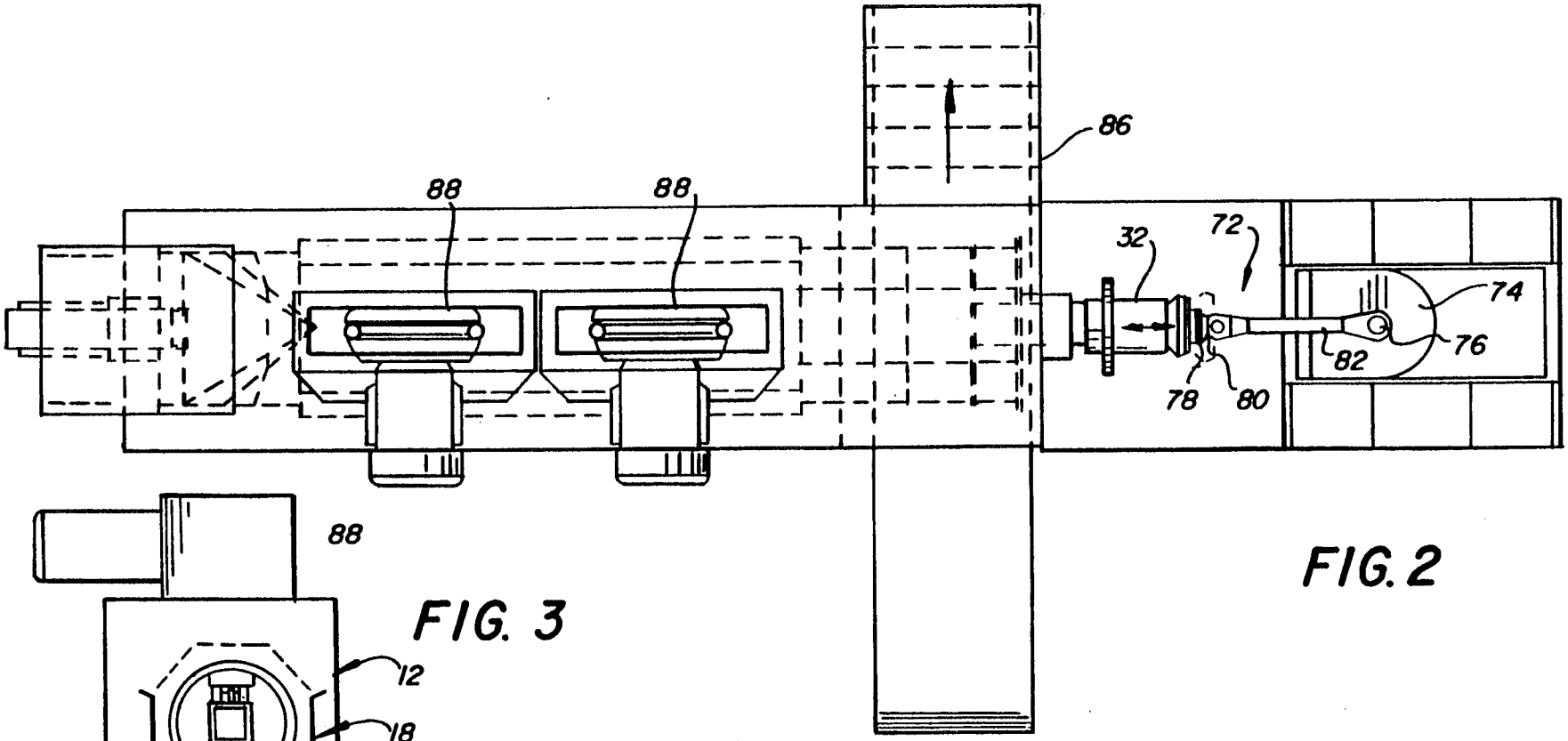
FIG. 2 is a plan view of the abrasive cleaning machine of FIG. 1 and shows further the general details thereof.

Referring now to FIGS. 1 and 2, it will be seen that there is connected to the free end of the right hand support shaft 32 a reciprocating drive unit 72 which includes an eccentric crank drive 74 having a crank pin 76. The crank pin 76 is connected to a rotatable connection 78 by way of a universal joint 80 and a crank rod 82. Thus, while the support shaft 32 is being oscillated, it is also being axially reciprocated. The eccentric 74 may be constructed to have a quick movement in one direction and a slower movement in the opposite direction so as to provide a sliding action to workpieces carried by the rocker barrel 18 and effect the conveying of such workpieces along the rocker barrel 18.

The manner in which workpieces are directed into the rocker barrel 18 forms no part of this invention. However, in FIGS. 1 and 2 there is schematically illustrated at the left end of the machine 10 a supply unit 84 which slopes down into the left end of the rocker barrel 18 so as to direct workpieces down into the open top rocker barrel. At the right end of the machine 10, there is a workpiece discharge area incorporating a conveyor 86. The rocker barrel 18, in the conventional manner, will be provided with a discharge opening which will permit the automatic dumping of workpieces out of the rocker barrel 18 on to the conveyor 86.

In order that workpieces moving along the rocker barrel 18 may be cleaned, there is mounted on the top of the frame 12 two abrasive throwing wheel units 88. These throwing wheel units 88 discharge cleaning abrasives into the frame 12 and down through the open top of the rocker barrel 18 so as to impinge upon the workpieces carried by the rocker barrel 18.

Figure 3:
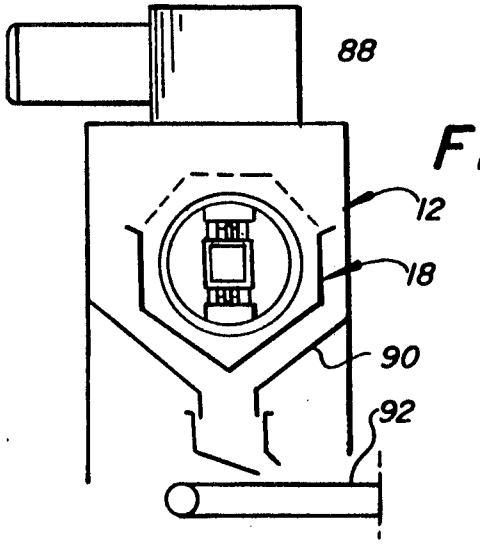
FIG. 3 is a sectional view taken through the interior of the abrasive cleaning machine of FIG. 1 and shows the general rocker barrel configuration and the supporting thereof at one end.

As is best shown in FIG. 3, with the understanding that the rocker barrel 18 has at least the bottom portion thereof of a perforated construction, it will be seen that the abrasives and materials removed by the abrasives from the workpieces, will pass down through the rocker barrel 18 into a hopper area 90 for discharge on a takeaway conveyor 92 in a generally conventional manner.

Figure 7:
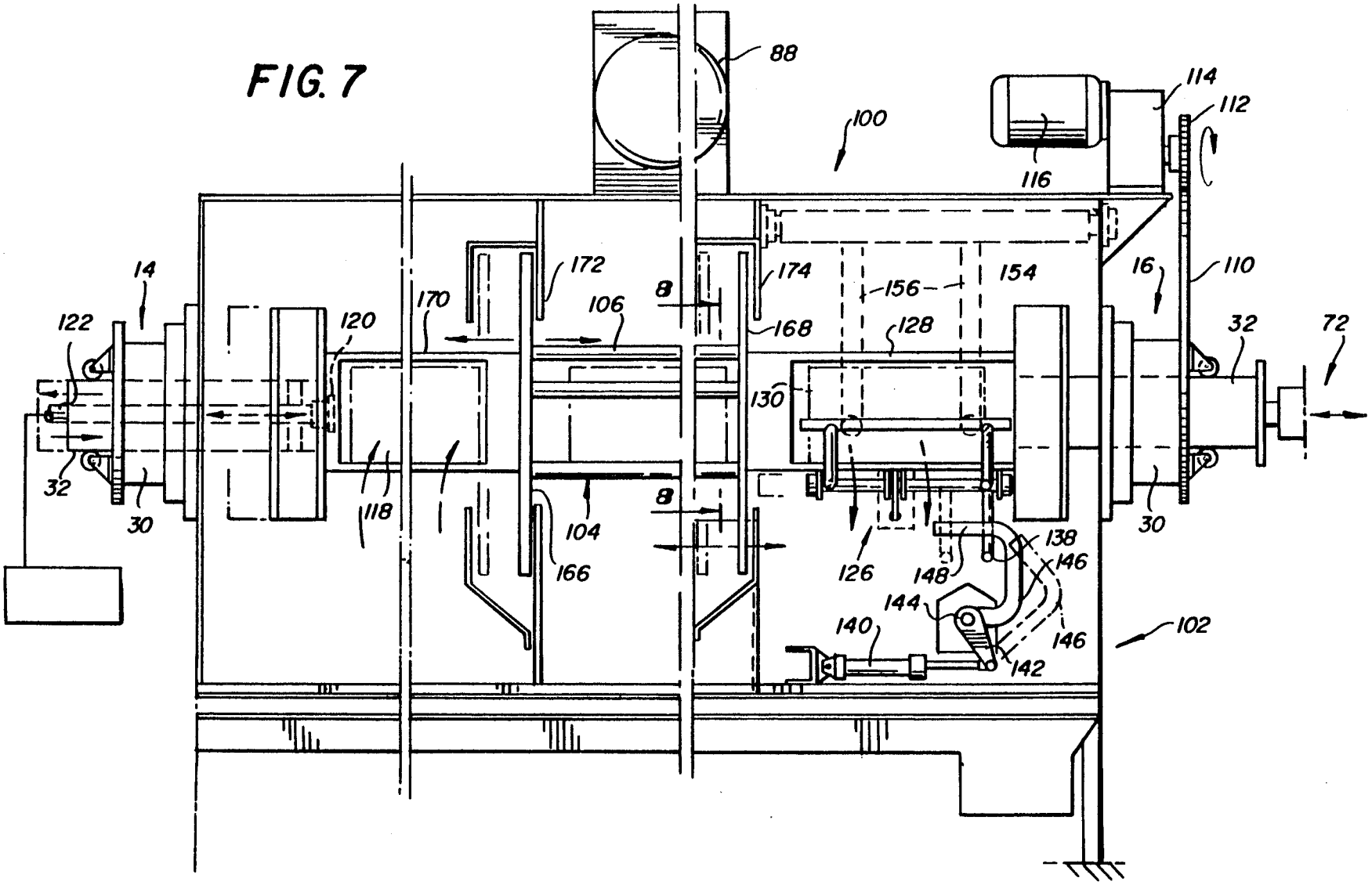
FIG. 7 is an elevational view with parts broken away and shown in section showing the general details of a modified form of abrasive cleaning machine wherein the work supporting conveyor is in the form of a continuous cage.
Figure 9:
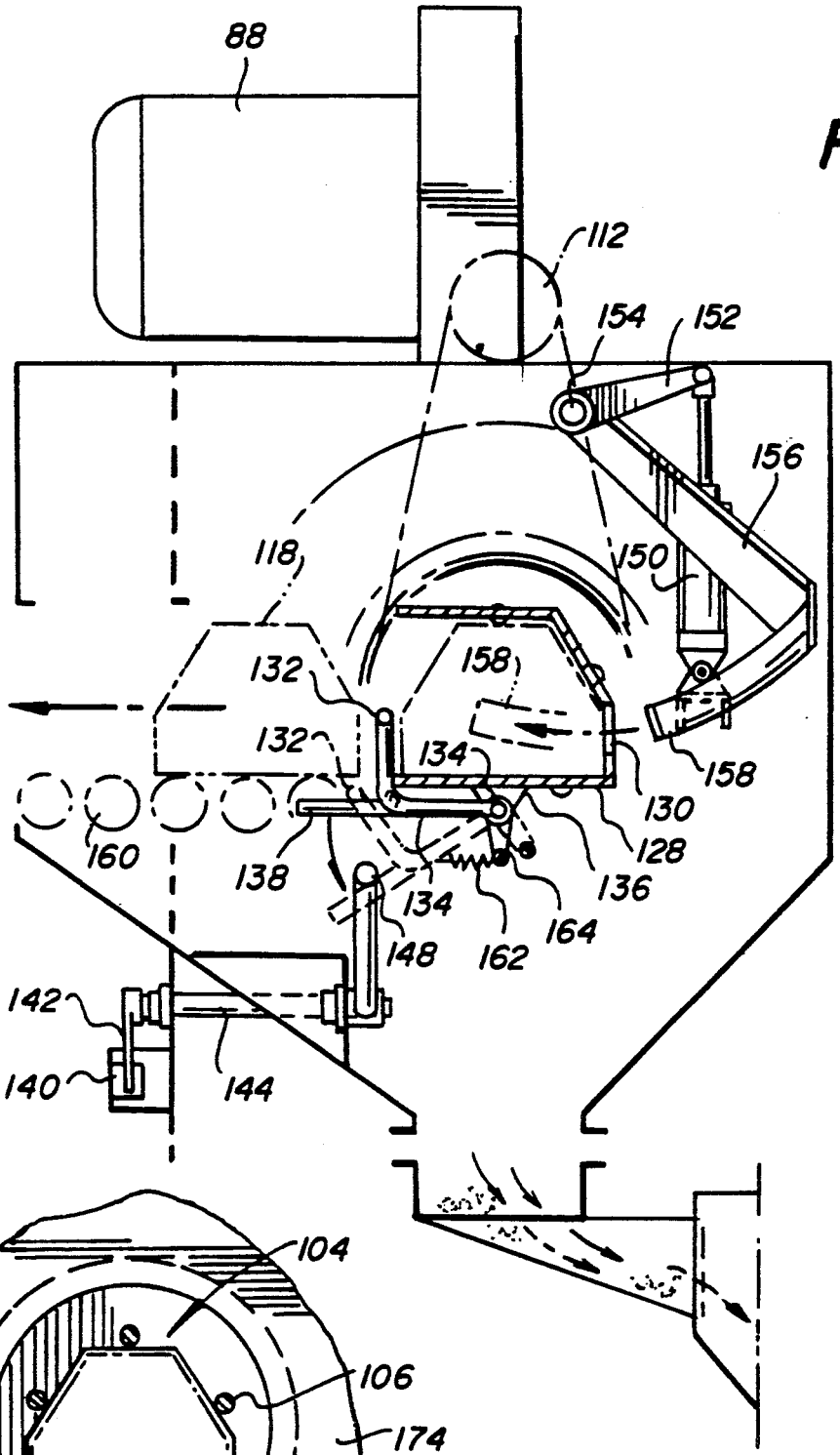
FIG. 9 is a transverse vertical sectional view taken at the discharge end of the abrasive cleaning machine and shows the manner in which a workpiece is released from and discharged from a terminal end of the work supporting cage.
Figure 8:
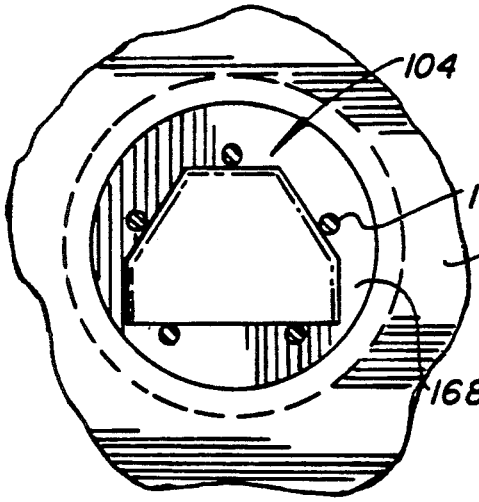
FIG. 8 is a fragmentary transverse vertical sectional view taken generally along the line 8—8 of FIG. 7 and shows the general cross section of the cage-like work supporting conveyor.

Referring now to FIGS. 7–9, it will be seen that there is illustrated a modified form of an abrasive cleaning machine generally identified by the numeral 100. The machine 100 includes a supporting frame 102 in which there is mounted utilizing the same support means 14 and 16 a cage-like conveyor which is generally identified by the numeral 104. The cage-like conveyor 104, in the illustrated embodiment of FIG. 8, is intended to support an engine block and is formed of a plurality of axially extending rods 106.

The cage-like conveyor 104 is intended to be continuously rotated and, as is best shown in FIG. 6, the ring member 54 and the chain segments 56 are replaced by a sprocket 108. The sprocket 108 is continuously driven by way of a chain 110 by a sprocket 112 carried by a gear reduction unit 114 driven by an electric motor 116. This is best shown in FIG. 7.

Although the cage-like conveyor 104 is simultaneously continuously rotated and axially reciprocated in a manner similar to that of the machine 10, it is to be understood that there are other modifications. The workpieces, engine blocks 118, are directed into the cage-like conveyor 104 at the left end thereof and are pushed into position by way of a reciprocating plunger 120 which may simply be in the form of a hydraulic cylinder 122 suitably mounted through the support shaft 32 of the left hand support means 14. This is diagrammetrically illustrated at the left of FIG. 7.

The cleaned engine block may either be automatically discharged at the right end of the cage-like conveyor 104 by omitting several of the support bars 104 at that end, or by a specific discharge mechanism generally identified by the numeral 126 and illustrated in FIGS. 7 and 9. The discharge mechanism 126 includes an end portion 128 of the cage-like conveyor 104 which is generally in the form of a housing. The housing 128 is provided with an opening 130 at one side thereof and the opposite side is defined by a bar 132 carried by a pair of support arms 132 which are pivotally mounted by way of a shaft 134 carried by a pair of axially spaced brackets 136. There is also an actuating arm 138.

In this embodiment of the machine, it is necessary to stop the rotation of the cage-like conveyor 104 in the position shown in FIG. 9. Then a fluid motor 140 is actuated to move to the right in FIG. 7 a lever arm 142 which is carried by a pivot shaft 144 which, in turn, carries a generally C-shaped actuator 146 including an arm 148. The arm 148 will engage the arm 138 and pull it down to pivot the bar 132 to a released position as shown in dotted lines in FIG. 9. The left side of the housing 130 is now open.

Then a fluid cylinder 150 is actuated to pull a lever arm 152, carried by a pivot shaft 154 down to pivot an elongated arm 156 in a clockwise direction so as to move a pusher 158 from right to left, as shown in dotted lines in FIG. 9 to push a workpiece 118 out of the housing 130. A suitable conveyor 160 may be provided for receiving the workpiece as shown in FIG. 9.

After the workpiece 118 has been discharged, the fluid motors 140, 150 are returned to their original positions. The bar 132 is then returned to its workpiece restraining position by way of a spring 162 which is connected to a lever arm 164 carried by the pivot shaft 134 as also shown in FIG. 9. As in the case of the machine 10, the machine 100 is also provided with abrasive throwing wheels 88. These are located generally in the center of the frame 102 and, if desired, suitable baffle means may be provided for preventing abrasive particles from entering the opposite ends of the frame 102. As is best shown in FIG. 7, the cage-like conveyor 104 may be provided with suitable baffle plates 166, 168 between which the rods 106 extend. The opposite ends of the conveyor 104 may be generally in the form of housing-like extensions including the aforedescribed housing 128 at the right end and a housing 170 at the left end specifically constructed for receiving a workpiece 118. The baffle plates 166, 168 are mounted for reciprocation and rotation with the conveyor 104 with the baffle plate 166 being associated with the baffle unit 172 and the baffle plate 168 being associated with the baffle unit 174 which permits such reciprocatory and rotational movement.

Although only two preferred embodiments of the machines have been specifically illustrated and described herein, it is to be understood that minor variations may be made in the machines without departing from the spirit and scope of the invention as defined by the appended claims.

I claim:

1. An abrasive cleaning machine comprising a frame, a work supporting conveyor, and support means supporting said conveyor in said frame for axial reciprocating movement and for rotational movement, said frame having at opposite ends a support portion carrying first bearing means, a support sleeve mounted in each of said first bearing means for rotational movement within said frame, said conveyor having a support shaft at each end, second bearing means mounting each support shaft in a respective support sleeve for axial movement, first drive means connected to one of said support sleeves for effecting rotational movement of said one support sleeve, movement transferring means between said one support sleeve and a respective one of said support shafts, and second drive means connected to one of said support shafts for effecting reciprocating axial movement of said support shafts within said support sleeves whereby said conveyor is simultaneously axially reciprocated and rotated.

2. An abrasive cleaning machine according to claim 1 wherein said movement transferring means includes a longitudinal rib, third bearing means engaging opposite sides of said rib, said rib being carried by a selected one of said one support sleeve and said respective support shaft, and said third bearing means being carried by the other of said one support sleeve and said respective support shaft.

3. An abrasive cleaning machine according to claim 2 wherein said third bearing means are in the form of rollers rolling on said rib in an axial direction.

4. An abrasive cleaning machine according to claim 2 wherein said longitudinal rib is carried by said respective support shaft, and said third bearing means are carried by said one support sleeve.

5. An abrasive cleaning machine according to claim 4 wherein said third bearing means are in the form of rollers rolling on said rib in an axial direction.

6. An abrasive cleaning machine according to claim 1 wherein said support sleeves are cylindrical and support shaft is rectangular.

7. An abrasive cleaning machine according to claim 1 wherein said suport sleeves are cylindrical and said support shaft is rectangular, and said second bearing means are in the form of rollers carried by said support sleeves and riding on said support shaft in an axial direction.

8. An abrasive cleaning machine according to claim 7 wherein said movement transferring means includes a longitudinal rib having third bearing means engaging opposite sides of said rib, said rib being carried by a selected one of said one support sleeve and said respective support shaft, and said third bearing means being carried by the other of said one support sleeve and said respective support shaft.

9. An abrasive cleaning machine according to claim 8 wherein said third bearing means are in the form of rollers rolling on said rib in an axial direction.

10. An abrasive cleaning machine according to claim 8 wherein said longitudinal rib is carried by said respective support shaft, and said third bearing means are carried by said one support sleeve.

11. An abrasive cleaning machine according to claim 10 wherein said third bearing means are in the form of rollers rolling on said rib in an axial direction.

12. An abrasive cleaning machine according to claim 1 wherein said support shafts are tubular and opening into said conveyors, and there is a workpiece pusher extending through at least one of said support shafts for pushing workpieces into said conveyor.

13. An abrasive cleaning machine according to claim 1 wherein said frame carries at least one abrasive throwing wheel for throwing abrasives towards said conveyor.

14. An abrasive cleaning machine according to claim 1 wherein said second drive means includes a crank and a crank arm connected to said one support shaft.

15. An abrasive cleaning machine according to claim 1 wherein said conveyor is an oscillating barrel, and said first drive means is an oscillatory drive.

16. An abrasive cleaning machine according to claim 1 wherein said first drive means is an oscillating drive and includes a drive unit including a sprocket and a chain segment fixedly carried by a driven member and engaged by said sprocket.

17. An abrasive cleaning machine according to claim 16 wherein said driven member includes a constant radius arcuate section, and said chain segment fixedly secured around said arcuate section.

18. An abrasive cleaning machine according to claim 1 wherein said conveyor is in the form of an elongated cage, and said first drive means are of the constant rotational type.

19. An abrasive cleaning machine according to claim 1 wherein each of said first bearing means is in the form of a large circular bearing having an outer roll fixed to said frame and an inner roll fixed to a respective support sleeve.

20. A cage-like conveyor for an abrasive cleaning machine, said conveyor having a discharge end, said conveyor including a housing portion at said discharge end, said housing portion including a side discharge opening, stop means normally closing said side discharge opening, said stop means being pivotally mounted relative to said housing portion for movement to an out-of-the-way position, and an actuator for engaging said stop means and moving said stop means to said out-of-the-way position, and a separate pusher for pushing a workpiece from said housing.

21. A cage-like conveyor according to claim 20 wherein there are means mounting said conveyor for rotational and reciprocatory movements, and said actuator is stationarily mounted.

22. A cage-like conveyor according to claim 20 wherein there are means mounting said conveyor for rotational and reciprocatory movements, and said pusher is stationarily mounted.

* * * * *